US011505908B2

(12) United States Patent
Tang et al.

(10) Patent No.: US 11,505,908 B2
(45) Date of Patent: Nov. 22, 2022

(54) DRILLING APPARATUS AND PHC PIPE CASED PILE, AND METHOD OF DRILLING WITH PHC PIPE CASED PILE

(71) Applicants: Guangzhou Municipal Engineering Testing Co., Ltd., Guangzhou (CN); Guangzhou Institute of Building Science Co., Ltd., Guangzhou (CN); Guangzhou Construction Engineering Co., Ltd., Guangzhou (CN); Guangzhou Municipal Construction Group Co., LTD., Guangzhou (CN)

(72) Inventors: Mengxiong Tang, Guangzhou (CN); Zhiguo Zhou, Guangzhou (CN); Xiaoli Sun, Guangzhou (CN); Jun Yang, Guangzhou (CN); Hesong Hu, Guangzhou (CN)

(73) Assignees: GUANGZHOU MUNICIPAL ENGINEERING TESTING CO., LTD., Guangzhou (CN); GUANGZHOU INSTITUTE OF BUILDING SCIENCE CO., LTD., Guangzhou (CN); GUANGZHOU CONSTRUCTION ENGINEERING CO., LTD., Guangzhou (CN); GUANGZHOU MUNICIPAL CONSTRUCTION GROUP CO., LTD., Guangzhou (CN)

( * ) Notice: Subject to any disclaimer, the term of this patent is extended or adjusted under 35 U.S.C. 154(b) by 79 days.

(21) Appl. No.: 17/158,718

(22) Filed: Jan. 26, 2021

(65) Prior Publication Data

US 2022/0081863 A1 Mar. 17, 2022

(30) Foreign Application Priority Data

Sep. 17, 2020 (CN) ..... 202010978951.1

(51) Int. Cl.

| | |
|---|---|
| ***E02D 7/26*** | (2006.01) |
| ***E02D 7/30*** | (2006.01) |
| *E02D 5/30* | (2006.01) |

(52) U.S. Cl.

CPC ..... *E02D 7/26* (2013.01); *E02D 7/30* (2013.01); *E02D 5/30* (2013.01); *E02D 2200/1685* (2013.01); *E02D 2300/002* (2013.01)

(58) Field of Classification Search

CPC combination set(s) only.
See application file for complete search history.

(56) References Cited

U.S. PATENT DOCUMENTS

| | | | |
|---|---|---|---|
| 8,074,740 | B2 | 12/2011 | Roussy |
| 10,557,323 | B2 | 2/2020 | Pope |
| 2017/0356249 | A1 | 12/2017 | Pelfrene et al. |

FOREIGN PATENT DOCUMENTS

| | | | |
|---|---|---|---|
| CN | 102561946 | A | 7/2012 |
| CN | 106120789 | A * | 11/2016 |

(Continued)

*Primary Examiner* — Kyle Armstrong
(74) *Attorney, Agent, or Firm* — Muncy, Geissler, Olds & Lowe, P.C.

(57) ABSTRACT

Provided is a drilling apparatus, comprising a PHC pipe cased pile having a drilling section for containing fluid and a hammer element arranged inside the cavity of the PHC pipe cased pile which moves along the drilling direction till the bottom of the drilling section. As the hammer element moves along the drilling direction till the bottom of the drilling section, a localized hydraulic force will be induced in the fluid contained in the drilling section of the PHC pipe cased pile by a sharp rise in the fluid pressure in addition to the impact force directly acted on the rock and soil by the hammer element. Under action of the hydraulic force and the impact force, the surrounding soft rock stratum could be crushed and the rock stratum with higher strength is left (Continued)

intact, that is, the drilling apparatus proceeds until harder rock. At this point, concrete casting will bond with the harder rock, resulting in a better bearing capacity of the PHC pipe cased pile foundation.

7 Claims, 3 Drawing Sheets

(56) References Cited

FOREIGN PATENT DOCUMENTS

| | | | | |
|---|---|---|---|---|
| CN | 111441350 | A | | 7/2020 |
| KR | 100478234 | B1 | * | 3/2005 |
| KR | 20140039589 | A | * | 4/2014 |
| KR | 20160017644 | A | * | 2/2016 |
| KR | 20200068124 | A | * | 6/2020 |
| KR | 102138899 | B1 | * | 7/2020 |

* cited by examiner

DRILLING APPARATUS AND PHC PIPE CASED PILE, AND METHOD OF DRILLING WITH PHC PIPE CASED PILE

CROSS REFERENCE TO RELATED APPLICATION

This application claims priority of Application No. 202010978951.1 filed in China on Sep. 17, 2020, under U.S.C. § 119, the entire contents of which are hereby incorporated by reference.

TECHNICAL FIELD

The following relates to the field of pile foundation engineering, in particular to the field of drilling with prestressed high strength concrete (PHC) pipe cased pile.

BACKGROUND OF INVENTION

In pile foundation engineering, a drill bit arranged inside a PHC pipe is used for drilling with the PHC pipe cased pile, wherein the PHC pipe cased pile is used for sinking a prestressed high strength concrete pipe into the drilled bore while drilling for simultaneous drilling, pile-sinking and dumping. Pile is formed by sealing the pile tip by rotary injecting grout or pouring concrete, and the outside of the pipe is filled with cement or cement mortar in order to improve the bearing capacity of the pile. The section of the PHC pipe cased pile that is close to the drilling operation or the drill bit is often referred to as a drilling section. However, for drilling with PHC pipe cased pile, the quality and efficiency of the construction can be basically guaranteed if the pile bearing stratum is extremely soft rock, or soft rock (i.e. rocks of which the compressive strength $f_{rk} \leq 15$ MPa); whereas if the pile bearing stratum is hard or harder rock (i.e. rocks of which the compressive strength $f_{rk} > 30$ MPa), it is quite difficult for the drill bit to squash the rock due to the high strength of the rock, thereby decreasing the construction efficiency after drilling into the rock. Therefore, with the foresaid limitation, the pile tip bearing stratum for PHC pipe cased pile is usually soft rock. To improve the bearing capacity of a single pile, the pile will vibrate to sink by a vibration generator when the construction reaches to the designed elevation of the bearing stratum, thereby compacting the bottom dregs and increasing the bearing capacity of the pile tip. But the vibration could result in cracks of the pile and lead to defects of constructional quality for the pile. In addition, the pile itself has excellent vertical resistance to static load, in the case of the pile bearing stratum is soft rock, the rock body provides limited resistance to the pile tip and limited ability of sinking controlling, which restricts potential improvement of the bearing capacity of the pile.

SUMMARY OF THE INVENTION

An aspect related to a drilling apparatus to improve the ability of drilling to harder rock and soil.

Provided is a drilling apparatus for drilling with PHC pipe cased pile, comprising a PHC pipe cased pile and a hammer element arranged inside cavity of the PHC pipe cased pile, the PHC pipe cased pile includes a drilling section, the cavity at the drilling section is used for containing fluid; the hammer element moves along the drilling direction till the bottom of the drilling section; at least one through hole is arranged on pipe wall of the PHC pipe cased pile at the drilling section.

Preferably, the at least one through hole is arranged in the moving path of the hammer element.

Preferably, the hammer element comprises a connecting column having a continuously tapered diameter in the direction away from the drilling section.

Preferably, the hammer element further comprises a hammer head connected with the connecting column, the hammer head has a continuously tapered diameter in the direction away from the connecting column.

Preferably, the hammer head is in a shape of cone.

Preferably, the drilling section of the pipe case pile is provided with reinforcing structures.

Further provided is a PHC pipe cased pile for drilling with PHC pipe cased pile, comprising a drilling section; wherein pipe wall of the PHC pipe cased pile forms a cavity for containing fluid; the pipe wall is configured with at least one through hole at the drilling section.

Further provided is a method of drilling with PHC pipe cased pile, comprising using a foresaid drilling apparatus; wherein the method further comprises steps of: drilling and forming a drilled bore, and installing the PHC pipe cased pile; injecting fluid into the cavity of the PHC pipe cased pile at the drilling section; driving the hammer element down to the bottom of the pile; as the hammer element moves down, the fluid in the cavity is forced to scour out the rock and soil underneath, and flows up outside the pipe wall along a gap between the pipe pile and the rock, then flows back to the cavity of the PHC pipe cased pile via the through hole, thus forming a fluid circulation to scour out the rock and soil.

Preferably, the method further comprises a step of delivering the rock debris out of the PHC pipe cased pile.

As compared with the prior art, the present invention has following technical advantages:

1. As the hammer element moves along the drilling direction till the bottom of the drilling section, a localized hydraulic force will be induced in the fluid contained in the drilling section of the PHC pipe cased pile by a sharp rise in the fluid pressure in addition to the impact force directly acted on the rock and soil by the hammer element. Under action of the hydraulic force and the impact force, the surrounding soft rock stratum could be crushed and the rock stratum with higher strength is left intact, that is, the drilling apparatus proceeds until harder rock. At this point, concrete casting will bond with the harder rock, resulting in a better bearing capacity of the PHC pipe cased pile foundation.
2. The PHC pipe cased pile having through hole/holes thereon is able to form a fluid circulation flowing from the bottom of the drilling section to the outside of the pile and to the inside of the pile via the through hole/holes, for scouring out the rock and soil.

BRIEF DESCRIPTION OF DRAWINGS

The present invention will be described hereinafter in details with reference to the figures and the embodiments, obviously, the figures to be described below are merely embodiments of the present invention. For those skilled in the art, other figures may be obtained according to these figures without any creative work.

LIST OF REFERENCE CHARACTERS

Figure 1:
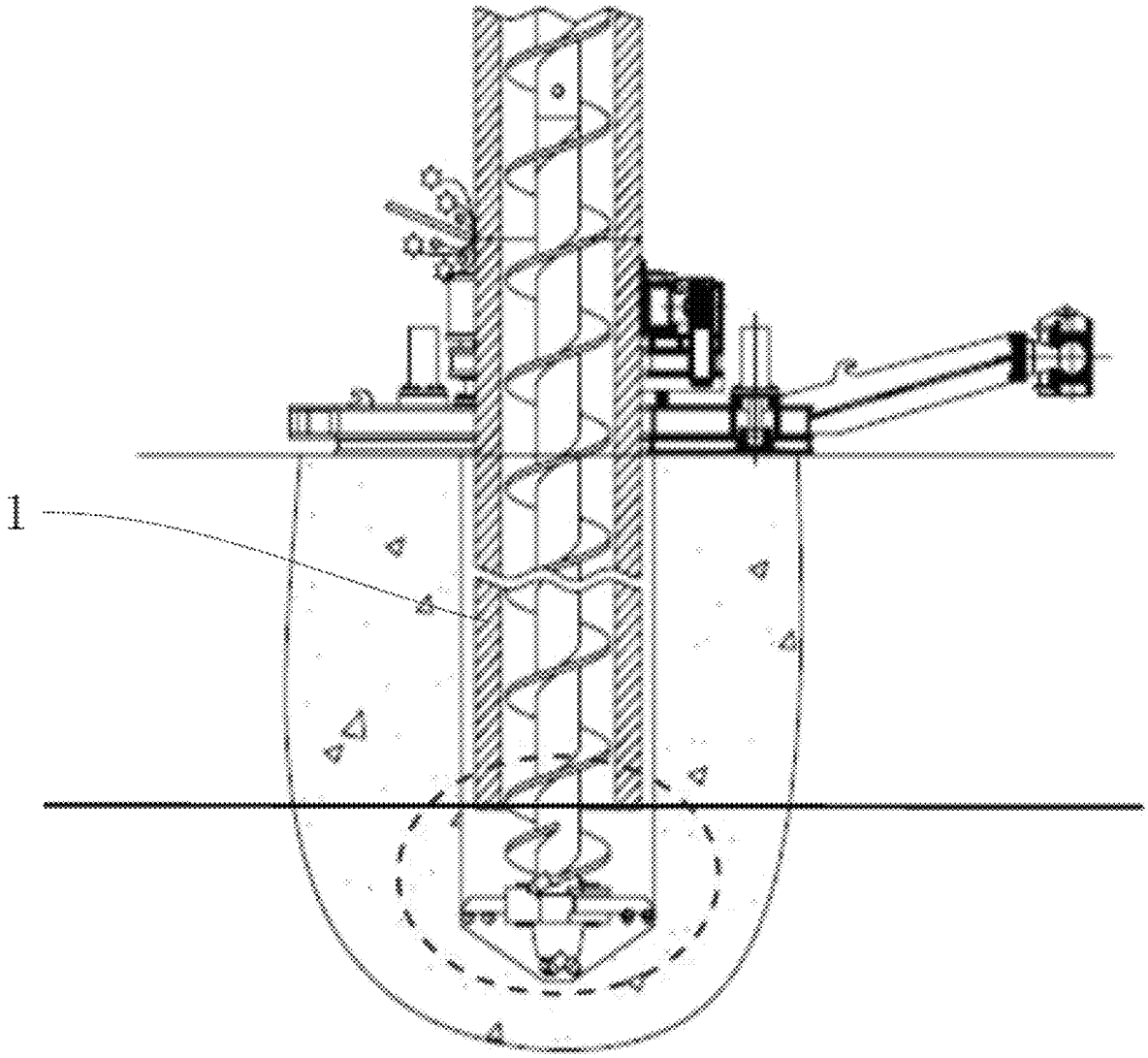
FIG. 1 is a schematic view illustrating a drill rod and PHC pipe cased pile carrying out drilling in prior art.

1 Drilling with PHC Pipe cased pile
11 Drilling section
12 Through hole
2 Hammer element
21 Connecting column
22 Hammer head
23 Cavity

DETAILED DESCRIPTION OF THE INVENTION

The invention will be described in more details hereinafter with reference to the figures and embodiments. It should be noted that the embodiments of the present invention and the features in different embodiments may be combined in a non-conflicting way. Although certain embodiments are described in detail for a better understanding, it should be understood that there may be more embodiments. Various changes and modifications may be obtained by those skilled in the art on the basis of the present invention without creative works and without departing the scope of the appended claims.

The technical terms used herein have the general meanings well understood by those skilled in the art unless otherwise defined. The terms in the description of the present invention have been presented for purposes of illustrating the embodiments, not limiting the present invention.

Embodiment 1

Figure 2:
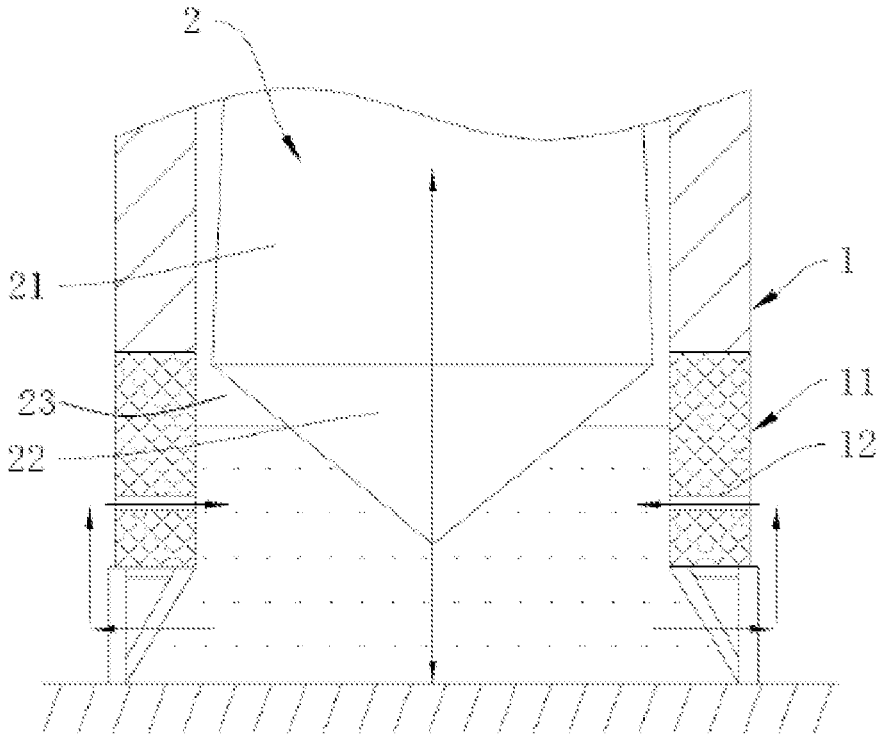
FIG. 2 is a schematic view illustrating the drilling apparatus and PHC pipe cased pile according to an embodiment of the present invention.

Provided is a drilling apparatus comprising a PHC pipe cased pile 1 and a hammer element 2 arranged inside a cavity 23 formed by a pipe wall of the PHC pipe cased pile 1, wherein the PHC pipe cased pile 1 includes a drilling section 11 at a distal end, the cavity 23 is used for containing fluid at the drilling section 11; the hammer element 2 is configured to replace traditional drill bit and drill rod as illustrated in FIG. 1 for drilling into rock stratum, moves along the drilling direction till the bottom of the drilling section 11; the moving direction of the hammer element 2 is shown as the double arrow pointing up and down in FIG. 2.

The pipe wall of the PHC pipe cased pile 1 is configured with at least one through hole 12 at the drilling section 11. As the hammer element 2 moves down, the fluid in the cavity 23 is forced to scour out rocks and soil and flows up outside the pipe wall along a gap between the PHC pipe cased pile 1 and the rock, then flows back to the cavity 23 of the PHC pipe cased pile 1 via the through hole 12, thus forming a fluid circulation to scour out rocks and soil. Due to the fluid circulation via the through hole 12, the ability of the drilling apparatus to drill to the rock and soil is improved as the fluid is able to scour out the rock and soil. The at least one through hole 12 is arranged in the moving path of the hammer element 2, so that when the hammer element 2 falls down past the through hole 12, a localized low pressure will be formed at the inner side of the through hole 12, which speeds up the flow rate of the fluid circulation and improves the ability of the fluid circulation to scour out the rock and soil.

The hammer element 2 comprises a connecting column 21 having a continuously tapered diameter in the direction away from the drilling section 11. Due to the tapered shape, the negative pressure formed at the inner side of the through hole 12 will increase continuously as the hammer element 2 moves down towards the bottom of the drilling section 11, which further speeds up the flow rate of the fluid circulation and improves the ability of the fluid to scour out the rock and soil. The hammer element 2 further comprises a hammer head 22 connected with the connecting column 21, the hammer head 22 has a continuously tapered diameter in the direction away from the connecting column 21. Due to the tapered shape, the impact force of the hammer element 2 acting on the rock is more concentrated and more advantageous to break harder rocks. The hammer head 22 may be shaped as a cone, whereby a corresponding concave shaped approximate an inverted conical will be formed in the rock and soil, which provides the sidewall an effect of expanding diameter when the surrounding rock and soil has poor properties, such as low strength or fracture development.

Embodiment 2

This embodiment is same as Embodiment 1 except that the drilling section 11 of the pipe case pile 1 is provided with reinforcing structure, which is selected from one or more of additional steel mesh, dense reinforcement, pre-embedded steel pipe, or the like. The kinetic energy of the hammer element 2 is increasing during its downward movement, so that the closer to the bottom of the drilling section 11, the greater the possibility of structural damage after the hammer element 2 accidentally contact the PHC pipe cased pile 1. Reinforcing structures could effectively reduce the risk of structural damage of the PHC pipe cased pile due to accidental collision.

Embodiment 3

This embodiment provides a PHC pipe cased pile 1 for simultaneous drilling, pile-sinking and dumping, comprising a drilling section 11; the pipe wall of the PHC pipe cased pile 1 forms a cavity at the drilling section 11 for containing fluid; the pipe wall of the PHC pipe cased pile 1 is configured with at least one through hole 12 at the drilling section 11, allowing the fluid flow out of the cavity from the bottom of the drilling section 11 to flow back into the cavity, therefore a fluid circulation to scour out the rock and soil is formed.

Embodiment 4

Figure 3:
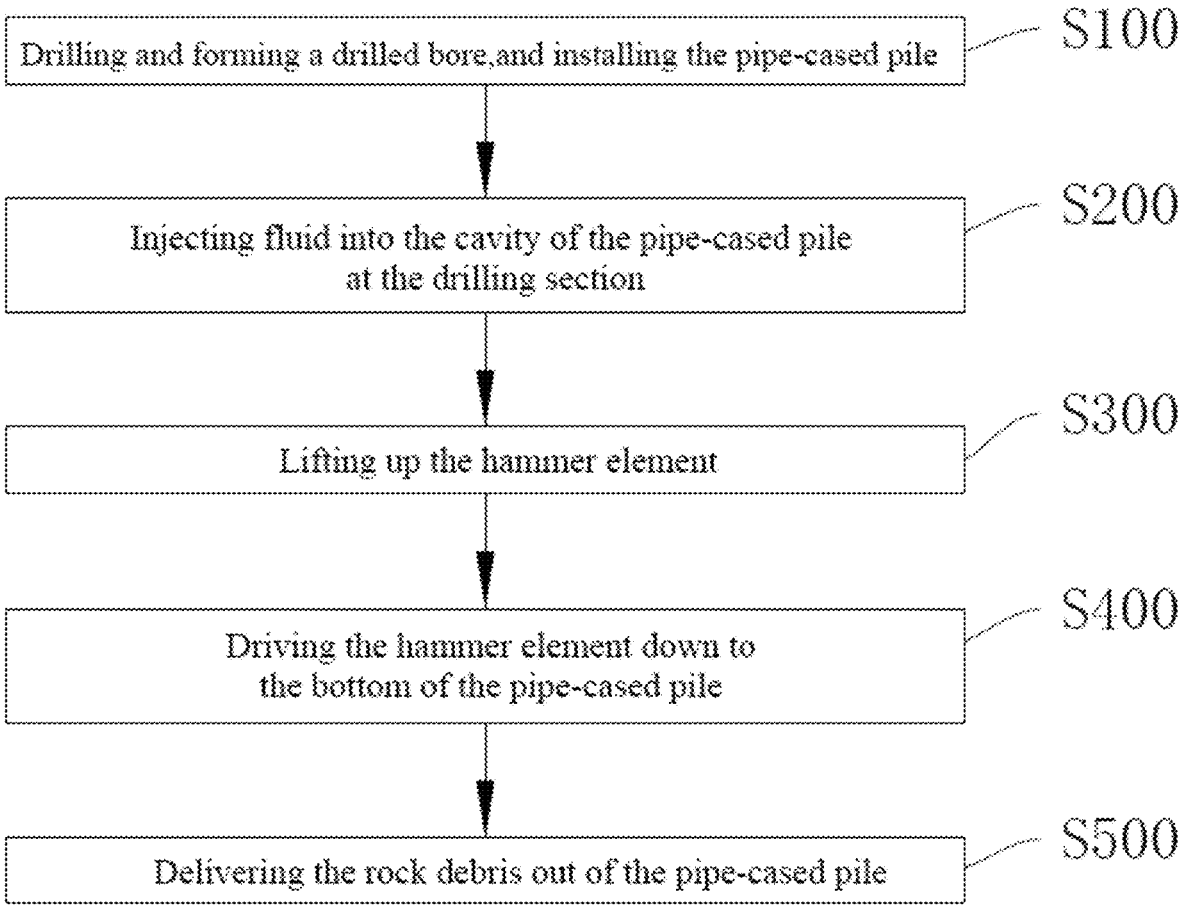
FIG. 3 is a flow chart of the drilling method in rock and soil according to the present invention.

This embodiment provides a method of drilling with PHC pipe cased pile, comprising using the foresaid drilling apparatus, further comprising steps shown in FIG. 3: S100, drilling and forming a drilled bore, and installing the PHC pipe cased pile 1; S200, injecting fluid into the cavity of the PHC pipe cased pile 1 at the drilling section 11; S300, lifting up the hammer element 2; S400, driving the hammer element 2 down to the bottom of the PHC pipe cased pile 1; S500, delivering the rock debris out of the PHC pipe cased pile 1. Delivering the rock debris out of the PHC pipe cased pile 1 helps to prevent the debris from counteracting the impact force, and further helps to form a better bonding between concrete casting inside the PHC pipe cased pile 1 with the harder rock stratum during subsequent concrete casting.

The embodiment described hereinbefore is merely preferred embodiment of the present invention and not for purposes of any restrictions or limitations on the invention.

It will be apparent that any non-substantive, obvious alterations or improvement by the technician of this technical field according to the present invention may be incorporated into ambit of claims of the present invention.

What is claimed is:

1. A drilling apparatus for drilling with prestressed high strength concrete (PHC) pipe cased pile, comprising a PHC pipe cased pile and a hammer element arranged inside a cavity formed by a pipe wall of the PHC pipe cased pile, the PHC pipe cased pile includes a drilling section at a distal end, the cavity is used for containing water at the drilling section; the hammer element moves along a drilling direction till a bottom of the drilling section; at least one through hole is arranged on the pipe wall of the PHC pipe cased pile at the drilling section.

2. The drilling apparatus of claim 1, wherein the at least one through hole is arranged in a moving path of the hammer element.

3. The drilling apparatus of claim 2, wherein the hammer element comprises a connecting column having a continuously tapered diameter in a direction away from the drilling section.

4. The drilling apparatus of claim 3, wherein the hammer element further comprises a hammer head connected with the connecting column, the hammer head has a continuously tapered diameter in a direction away from the connecting column.

5. The drilling apparatus of claim 4, wherein the hammer head is in a shape of cone.

6. A prestressed high strength concrete (PHC) pipe cased pile, comprising a drilling section at a distal end; wherein a pipe wall of the PHC pipe cased pile forms a cavity for containing water at the drilling section; the pipe wall is configured with at least one through hole at the drilling section.

7. A method of drilling with prestressed high strength concrete (PHC) pipe cased pile, comprising steps of:

providing a drilling apparatus, comprising a PHC pipe cased pile and a hammer element arranged inside a cavity formed by a pipe wall of the PHC pipe cased pile, the PHC pipe cased pile includes a drilling section at a distal end, the cavity is used for containing water at the drilling section; the hammer element moves along a drilling direction till a bottom of the drilling section; at least one through hole is arranged on the pipe wall of the PHC pipe cased pile at the drilling section;

drilling and forming a drilled bore, and installing the PHC pipe cased pile;

injecting water into the cavity of the PHC pipe cased pile at the drilling section; and driving the hammer element down to a bottom of the PHC pipe cased pile; as the hammer element moves down, the water in the cavity is forced to scour out rocks and soil underneath, and flows up outside the pipe wall along a gap between the PHC pipe cased pile and the rocks, then flows back to the cavity of the PHC pipe cased pile via the at least one through hole, thus forming a water circulation to scour out the rocks and soil.

* * * * *